US005513398A

United States Patent [19]

Dodge

[11] Patent Number: 5,513,398

[45] Date of Patent: May 7, 1996

[54] FUTON TILT MECHANISM

[75] Inventor: Peter W. Dodge, 1822C S. 5th St., Minneapolis, Minn. 55413

[73] Assignees: Richard D. Donohoo; Peter W. Dodge

[21] Appl. No.: 353,104

[22] Filed: Dec. 9, 1994

[51] Int. Cl.[6] ..... A47C 17/04

[52] U.S. Cl. ..... 5/37.1; 5/47; 5/38

[58] Field of Search ..... 5/37.1, 38, 47, 5/48

[56] References Cited

U.S. PATENT DOCUMENTS

| | | | |
|---|---|---|---|
| 835,770 | 11/1906 | Williams . | |
| 2,324,675 | 7/1943 | Burton | 5/37.1 |
| 2,343,642 | 3/1944 | Burton | 5/37.1 |
| 3,634,893 | 1/1972 | Hern | 5/37.1 |
| 4,829,611 | 5/1989 | Fireman | 5/47 |
| 4,875,244 | 10/1989 | Tremblay | 5/37.1 |
| 4,996,730 | 3/1991 | Fireman | 5/37.1 |
| 5,129,114 | 7/1992 | Withers | 5/37.1 |
| 5,146,640 | 9/1992 | Barton et al. | 5/47 |

*Primary Examiner*—Michael J. Milano
*Attorney, Agent, or Firm*—Jacobson & Johnson

[57] ABSTRACT

A futon with a tilt mechanism to enable a user to transfer the futon from a bed position to a couch position or vice a versa, with the mechanism including a back pad support member including rollers for engaging guide slots to permit lateral displacement of the pad support member with respect to a frame, with the back pad support member including a pair of lever arms with the back pad support member pivotally attached to a seat pad support member, with the seat pad support members having a pair of legs pivotally mounted thereto, with the legs pivotal between a first position for supporting a free end of the seat pad support member as a bed and a second position for engaging the lever arms on the back pad support members to enable a user to use the seat pad support member as a lever to raise the back side pad support member from a horizontal position to a generally vertical position and thereby convert the futon from a bed to a couch while simultaneously storing the pivotable legs in an out-of-the-way condition.

11 Claims, 4 Drawing Sheets

FUTON TILT MECHANISM

FIELD OF THE INVENTION

This invention relates generally to futons and, more specifically, to improvements to a tilt mechanism which uses pivotal legs for supporting one end of the futon or for engaging the back rest of the futon, thus enabling rapid transfer of a futon from a bed position to a couch position and vice versa.

BACKGROUND OF THE INVENTION

The concept of devices for tilting a sofa bed between a bed position or a couch position are old in the art. Typically, they use some type of pawl or dog which engages one part of a folding frame with a second part of a folding frame. Generally, these members require gravity to force the pawl or dog into a condition which causes latching between the two parts of the folding frame.

The present invention provides a pair of pivotal legs which, in a first position, are used to support the cantilevered end of one end of a first tiltable pad support member. A user can manually pivot the legs as a unit to a second position where the legs are out-of-the-way and are in engagement with a second tiltable pad support member which enables quick conversion of the futon from the bed position to the couch position. In addition, a pair of rollers allows the pad support members to slide along the frame to allow for laterally positioning the bed or couch against or away from a wall without having to move the frame supporting the tiltable pad support members.

BRIEF DESCRIPTION OF THE PRIOR ART

U.S. Pat. No. 5,146,640 shows a latching assembly for a sofa bed which uses pawls to hold the seat and back in position.

U.S. Pat. No. 4,996,730 shows a sofa bed recliner with a mechanism which allows the back member to move forward as a user converts the unit from a couch to a bed.

U.S. Pat. No. 4,829,611 shows a sofa bed recliner with a detent which locks the frames to allow movement from a horizontal to a vertical condition.

U.S. Pat. No. 835,770 shows a convertible couch and bed with pivoting links for movement from a couch position to a seat position.

U.S. patent shows a sofa bed assembly with the back and seat pivotal with respect to one another to permit conversion from the upright condition to the bed condition.

U.S. Pat. No. 2,343,642 shows a latch and dog arrangement for holding the back in relation to the seat.

U.S. Pat. No. 2,324,675 shows a further embodiment of the latch and dog arrangement of U.S. Pat. No. 2,343,642.

U.S. Pat. No. 4,875,244 shows sofa bed with a triangular block for engaging the back and seat area with each other.

SUMMARY OF THE INVENTION

Briefly, the invention comprises a futon with a tilt mechanism to enable a user to transfer the futon from a bed position to a couch position or vice versa. The tilt mechanism includes a back pad support member, including rollers for engaging guide slots on a frame to permit lateral displacement of the pad support member with respect to the frame. The back pad support member includes a pair lever arms with the back pad support member pivotally attached to a seat pad support member. Pivotally attached to the seat pad support member is a pair of legs with the legs pivotable between a first position for supporting the free end of seat pad support members as a bed and a second position for engaging the lever arms on the back pad support members. A cross brace connects the legs together to allow the legs to operate as a unit which enables the user to simultaneously engage or disengage the legs with the lever arms on the back pad support member. The legs lock the back pad support member and the seat pad support member at substantially right angles to each other, so a user can use the seat pad support member as lever to raise the back side member from a horizontal position to a generally vertical position and thereby convert the futon from a bed to a couch.

DESCRIPTION OF THE PREFERRED EMBODIMENT

Figure 1:
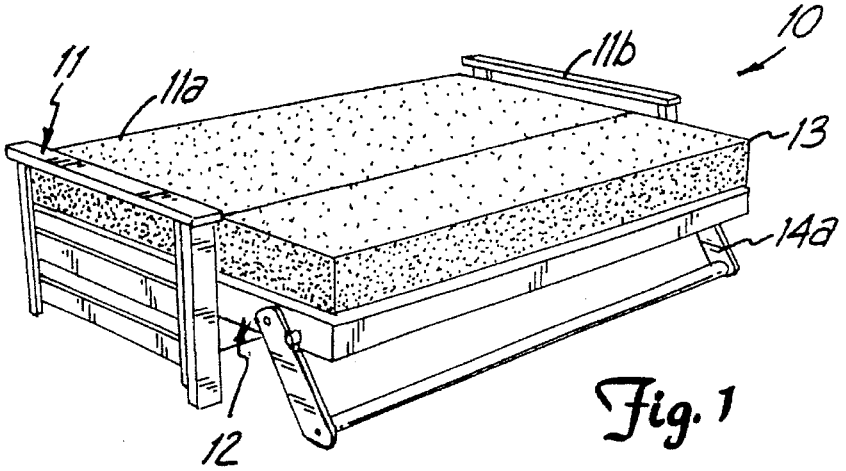
FIG. 1 shows a perspective view of the futon of the present invention in the bed position.

FIG. 1 reference numeral 10 generally identifies my futon located in a bed position. Futon 10 has a pad 13 which is partially supported in a horizontal position by pad support member 12 which has one end supported off the floor on one side by a frame 11 and a free end cantilevered over the frame 11. with the free end of frame 11 supported by a pair of pivotable legs 14 and 14*a* connected together by a cross brace 15. Frame 11 includes a first arm rest 11*a* located on one end of pad 13 and a second arm rest 11*b* located on the opposite end of pad 13 to form a stationary support for the futon in either the couch position or the bed position.

Figure 2:
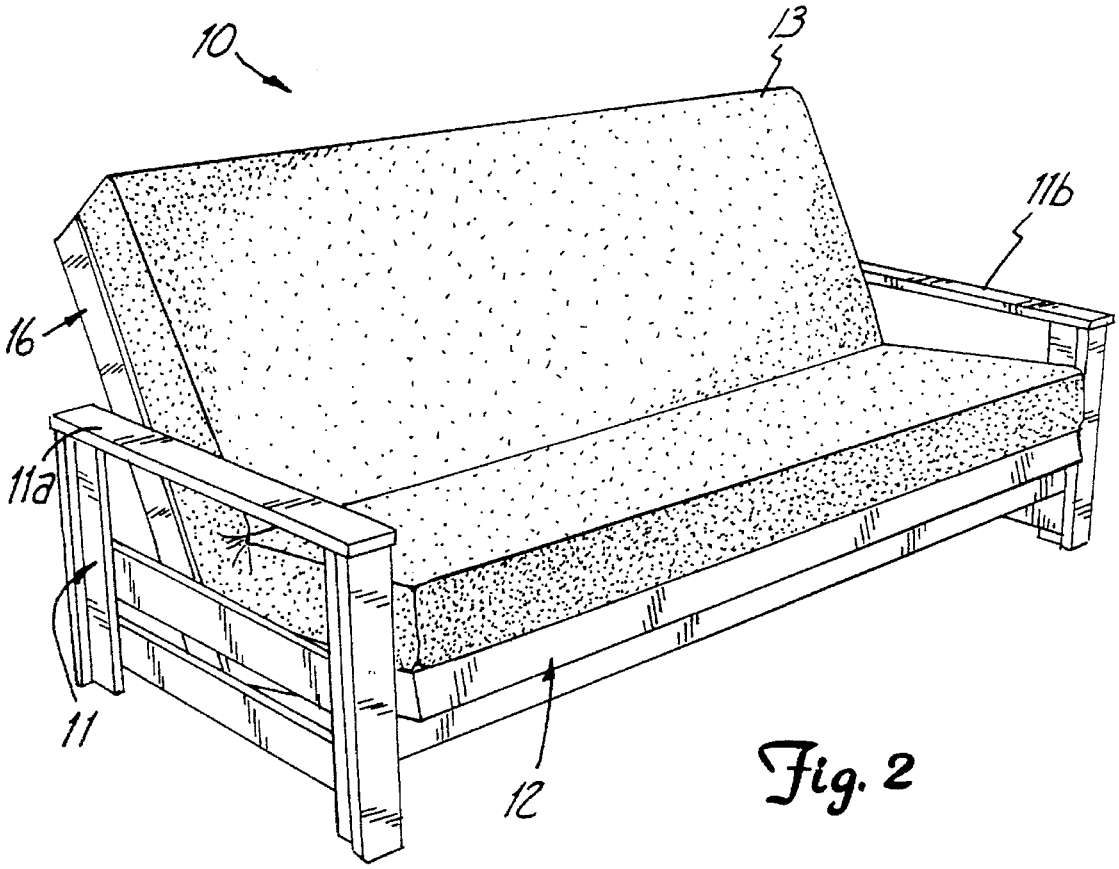
FIG. 2 shows a perspective view of the futon of the present invention in the couch position.

FIG. 2 shows futon 10 in the couch position with pad 13 supported by a first pad support member 16 and a second pad support member 12. Briefly, futon 10 is movable between the couch position shown in FIG. 2 to the bed position shown in FIG. 1 through the coaction of members on the first pad support member 16 and the second pad support member 12.

Figure 4:
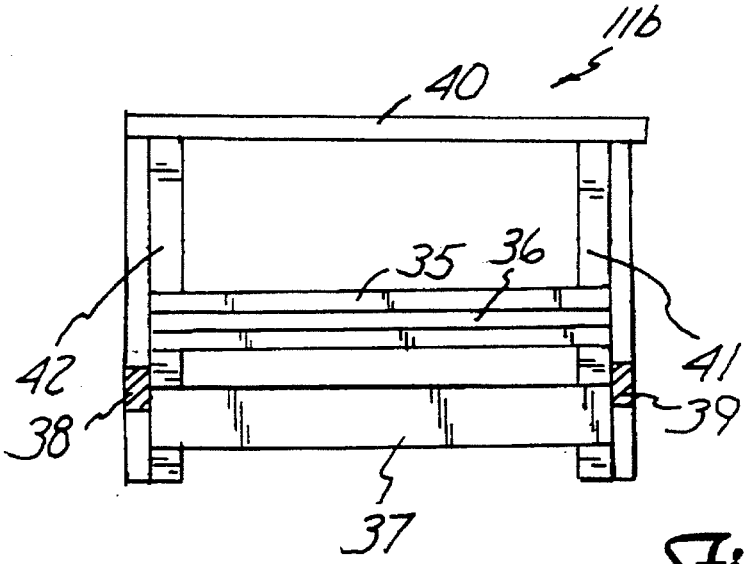
FIG. 4 shows an end view partially in section of the arm rest for the futon.

FIG. 4 shows arm rest 11*b* in a cutaway view showing arm rest 11*b* has a generally rectangular shape with cross members 38 and 39 which extend perpendicularly from arm rest 11*b* to an opposite arm rest 11*a* (FIG. 2) to from a rigid frame for supporting pad support member 12 and pad support member 16. Because the two arm rests are identical, this application describes only one.

Arm rest 11*b* includes a pair of vertical legs 41 and 42 and a lower cross brace 37, an intermediate cross brace 35 and a top cross brace 40 which can function as a forearm resting region. Located in intermediate cross brace 35 is a horizontal extending guide slot 36 to permit a user to position pad support members laterally therealong. That is, guide slots in the arm rests permit a user to position the futon adjacent to a wall regardless whether the futon is in the couch position as shown in FIG. 2 or the bed position as shown in FIG. 1 without having to move the arm rests.

Figure 3:
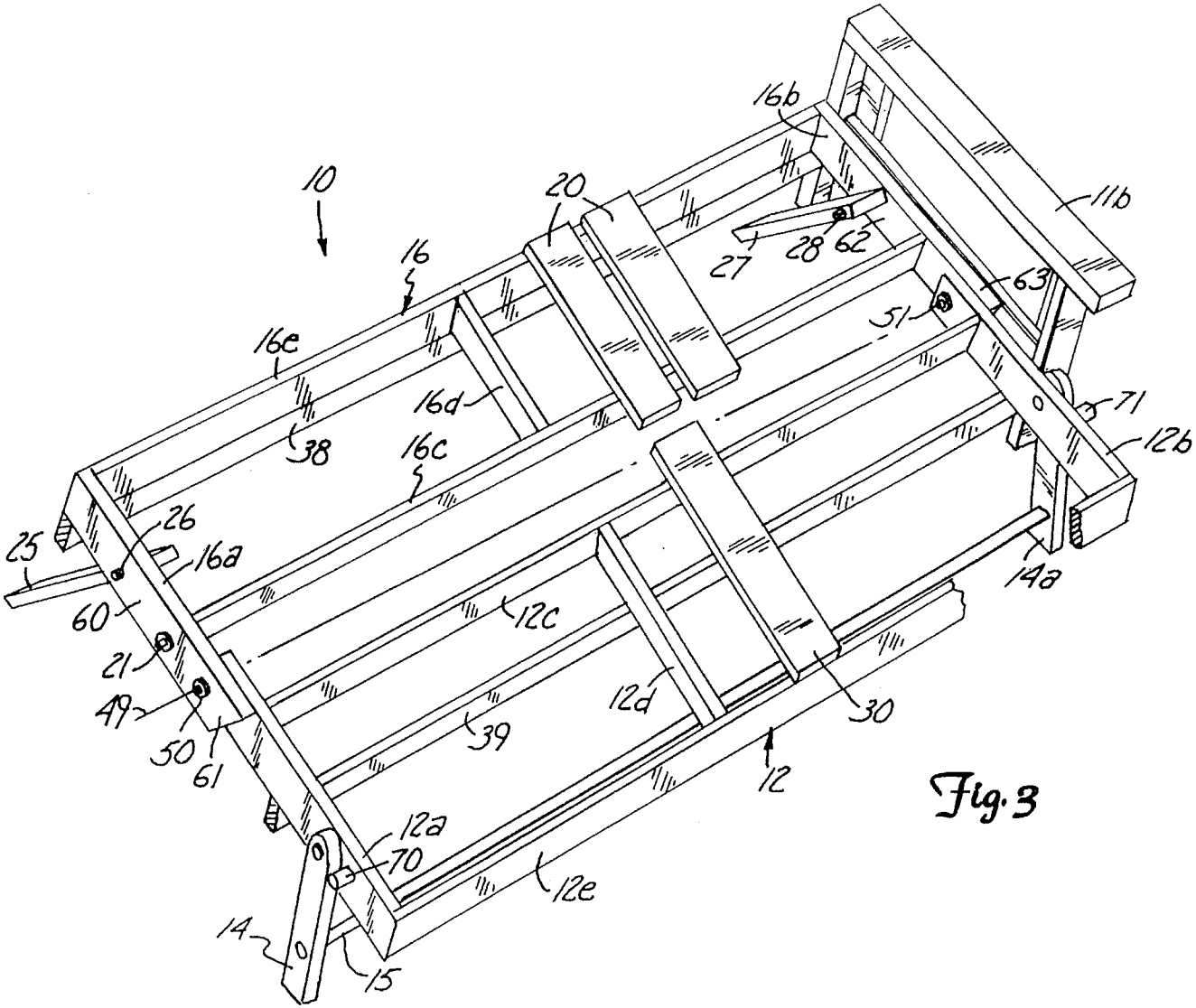
FIG. 3 shows a perspective view of the futon of the present invention in the bed position with the pad and a portion of the supporting members removed to reveal the internal components of the futon.

To understand the invention, refer to FIG. 3 which shows a cutaway view with pad 13 removed from futon 10. FIG. 3 also shows futon 10 with all but three pad support slats removed from the pad support members 16 and 12. Futon 10 includes a generally rectangular shaped first pad support member 16 having a first back side end member 16*a* and a second back side end member 16*b* located in a spaced parallel relationship to each other. A cross rail 16*c* and a cross member 16*e* extend from end to end with a cross brace 16*d* extending transverse to members 16*e* and 16*c*. A set of slats 20 extends transverse across first pad support member 16 to support a portion of pad 13 thereon. Slats 20 extend in a spaced relationship across member 16 to provide support for a portion of pad 13; however, for purpose of illustration, this figure shows only two slats.

Extending outward from back end member 16*a* is a first nylon roller 21 for slideingly engaging a guide slot in a cross brace on a first arm rest 11*a*, and, similarly, on the opposite side is an identical nylon roller (not shown) for engaging a guide slot in a cross brace on second arm rest 11*b*. Pivotally attached to back side end member 16*a* is a first back leg 25 held onto member 16*a* by a pivot member 26 such as a bolt or the like. Similarly, pivotally attached to back side end member 16*b* is a second back leg 27 held onto member 16*b* by a pivot member 28 such as a bolt or the like.

Futon 10 includes a second generally rectangular shaped second pad support member 12 having a first seat side end member 12*a* and a second seat side end member 12*b* located in a spaced parallel relationship to each other. A cross rail 12*c* and a cross member 12*e* extend from end to end with a cross brace 12*d* extending transverse to members 12*e* and 12*c*. A set of slats 30 extends transverse across first pad support member 16 to support a portion of pad 13 thereon; however, for purpose of illustration, this figure shows only one slat 30 but other slates would extend in a spaced relationship across member 12 to support a portion of pad 13 thereon. Slats 20 and 30 extend only partially toward each other to permit folding the support pad members about a pivot axis identified by reference numeral 49.

Pad support members 16 and 12 are pivotable with respect to each other along a centerline 49 which extends through a first pivot member 50 which extends through back side end member 16*a* and end member 12*a*. Similarly. a second pivot member 51 extends through back side end member 16*b* and end member 12*b*. In the preferred embodiment, pivot members 50 and 51 are bolts and pad support members are made of wood.

The back side end member 16*a* has two sections, an extension 60 located to the left of centerline 49 and a shorter lever arm 61 located to the fight of centerline 49. Similarly, the back side end member 16*b* has two sections. an extension 62 which is located to the left of centerline 49 and a shorter lever arm 63 located to the fight of centerline 49.

Figure 5:
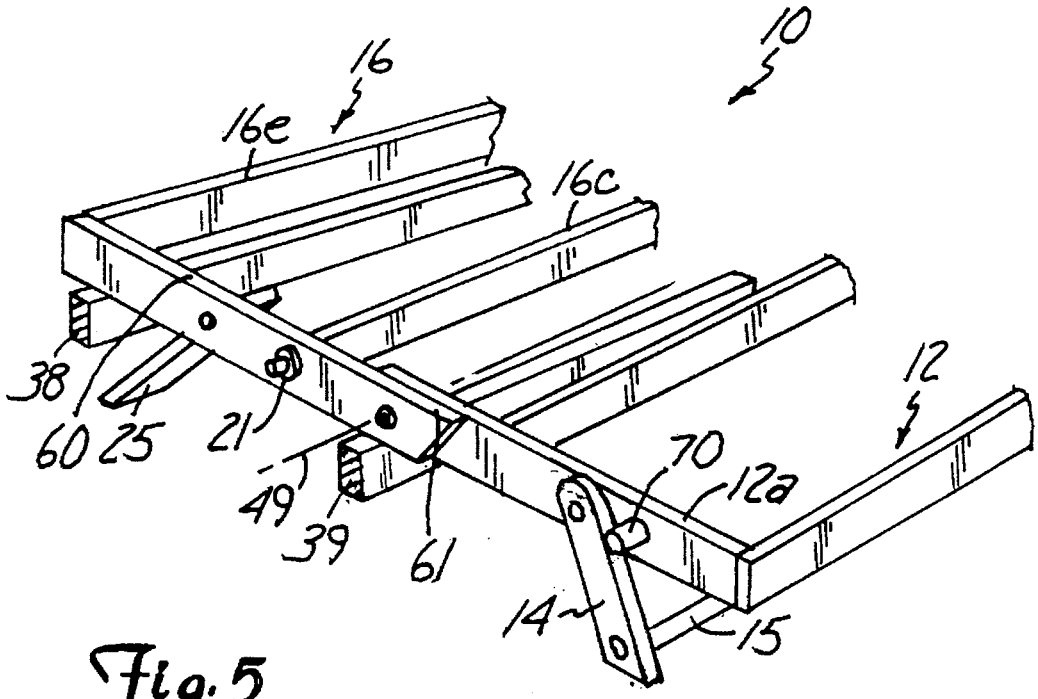
FIG. 5 shows one side of the futon pad support members in the bed position.
Figure 6:
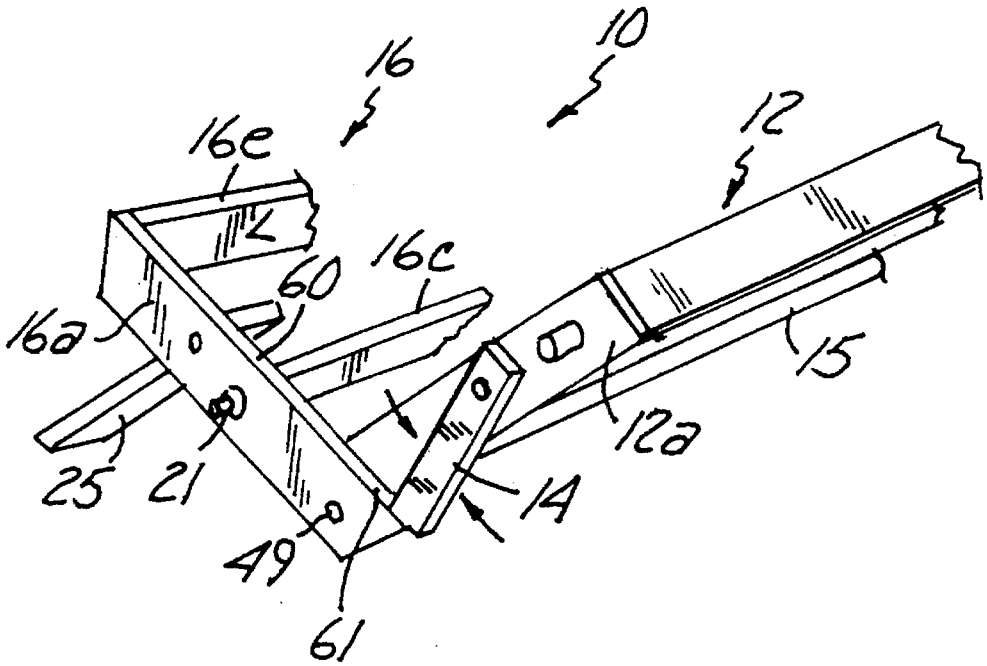
FIG. 6 shows the tilt mechanism of FIG. 6 (FIG. 6?) being used to tilt the futon from the bed position to the couch position.
Figure 7:
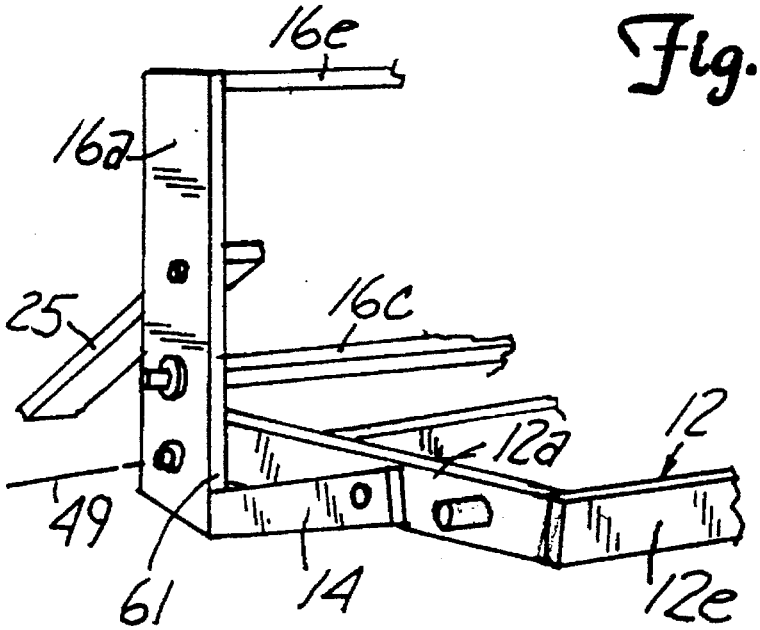
FIG. 7 shows the futon of FIG. 5 in the couch position with back side end member generally vertical and the seat member in a generally horizontal condition.

To understand the operation of the tilt mechanism of the present invention, refer to FIGS. 5–7 which, for ease in comprehension. show only one side of futon pad support members in three different positions. FIG. 5 shows the futon pad support members 12 and 16 in the bed position. FIG. 6 shows the tilt mechanism being used to tilt the futon from the bed position to the couch position. FIG. 7 shows futon 10 in the couch position with back side end member generally vertical and seat member 12 in a generally horizontal condition.

FIG. 5 shows futon pad support members 12 and 16 in the bed position with both pad support members located essentially in horizontal alignment with each other to support pad 13 as a bed. FIGS. 5 and 3 show that legs 14 and 14*a* support the free or cantilevered end of pad support member 12 which is located outside rail 39. A stop 70 on member 12*a* prevents pivotable leg 14 from collapsing as a user places weight on pad support member 12.

Similarly, a stop 71 on member 12*b* prevents pivotable leg 14*a* from collapsing when a user places weight on pad support member 12. Pivotable legs 14 and 14*a* are positioned with respect to stops 70 and 71 so the legs are at a forward angle of 10 degrees or more to ensure that the legs would not inadvertently pivot inward and allow the free end of pad support member to accidentally tip.

To transfer futon 10 from the bed position (FIG. 5) to the couch position (FIG. 7), a user lifts member 12 upward on pad support member 12 as shown in FIG. 6. He or she next grasps cross rail 15*a* and pivots legs 14 and 14*a* backward until one end of leg 14 engages lever arm 61 on back side end member 16*a* and the other leg 14*a* engages lever arm 63 on back side end member 16*b*. In this condition, leg 14 and its counterpart 14*a* hold pad support member 16 and pad support member at substantially fight angles to one another. In addition, legs 14 and 14*a*, which were used to support one end of pad support member, are folded inward out of the way. Once the legs are engaged as shown in FIG. 6, a user then lowers pad support member 12 to a substantially horizontal position which forces pad support member 16 to the substantially vertical position as illustrated in FIG. 7. In this condition, leg 25 and its counterpart leg 27 tilt downward as shown to provide support for back pad support member 16. Simultaneous with the tilting of the pad support members from the bed to the couch position. one end of the pad support member 15 slides laterally along a guide slot in arm rest 11*a* and a second end of pad support member slides laterally along a guide slot in arm rest 11*b* to enable lateral repositioning of pad support members 12 and 16 without having to move arm rests 11*a* and 11*b*, thus eliminating the need for lifting or moving the support frame. Consequently, a user can position futon 10 so that, in either the couch position or the bed position. the futon is proximate a wall without a user having to lift the main frame.

Thus, to transfer futon from the bed position to the couch position, a user lifts pad support member 12 and engages legs 14 and 14*a* which move as a unit with lever arms 61 and 63. When they are engaged, a user pushes down on pad support member 12 to rotate pad support member 16 to the vertical position which allows the use of futon 10 as a couch. Transferring futon 10 from the couch position to the bed position reverses the procedure. A user lifts pad support member upward until legs 14 and 14*a* disengage with lever arms 61 and 63 which permits back pad support member 16 to move downward to the bed position shown in FIG. 5.

I claim:

1. A futon for tilting from a bed position to a couch position comprising:

a frame, said frame having guide slots therein;

a first pad support member, said first pad support member including projections for engaging said guide slots to permit lateral displacement of said first pad support member with respect to said frame, said first pad support member including a pair of back side end members, each of said back side members having a lever arm;

a second pad support member, said second pad support member having a pair of seat end members located in pivotal engagement with said pair of back side end members, said second pad support member having one end normally supported by the frame and a second free end cantilevered outward from the frame; and a pair of legs, said legs pivotally mounted to said seat end members, said legs pivotal between a first position for supporting the free end of the pad support members as a bed and a second position for engaging the lever arms on said back side end members to enable the use of the second pad support members as a lever to raise the first pad support members from a horizontal position to a generally vertical position to convert the futon from a bed to a couch.

2. The futon of claim 1 including a member for connecting the pair of legs together so the pair of legs move as a unit.

3. The futon of claim 2 wherein the seat end members have a stop to limit the pivotal motion of the pair of legs.

4. The futon of claim 3 wherein the second pad support member includes slats for supporting a portion of a pad thereon.

5. The futon of claim 4 wherein the first pad support member includes slats for supporting a further portion of a pad thereon.

6. The futon of claim 5 wherein the projections include nylon rollers for slidingly engaging said guide slots.

7. The futon of claim 6 wherein the frame includes arm rests secured thereto.

8. The futon of claim 7 wherein the back side end members includes rear legs for supporting said first pad support member as a couch.

9. The futon of claim 8 wherein the guide slots extend generally in a horizontal direction to permit sliding said first pad support member away from a wall when the futon is converted from a couch to a bed without having to lift the frame for supporting the pad support members.

10. The futon of claim 9 wherein the futon frame is made of wood and the pad support members are made of wood.

11. A futon for tilting from a bed position to a couch position comprising:

a frame having a first pad support member and a second pad support member laterally displaceable with respect to said frame, with the first pad support member including a pair of lever arms thereon, and the second pad support member located in pivotal engagement with the first pad support member, with the improvement comprising a pair of legs pivotally mounted to said second pad support member, with said legs pivotal between a first position for supporting a free end of the first pad support member as a bed and a second position for engaging the lever arms on said first pad support member to enable the use of the second pad support member as a lever to raise the first pad support member from a horizontal position to a generally vertical position to convert the futon from a bed to a couch.

* * * * *